US010216134B2

(12) United States Patent
Ishikura

(10) Patent No.: US 10,216,134 B2
(45) **Date of Patent: *Feb. 26, 2019**

(54) IMAGE FORMATION DEVICE AND METHOD FOR STARTING IMAGE FORMATION DEVICE

(71) Applicant: Sharp Kabushiki Kaisha, Sakai, Osaka (JP)

(72) Inventor: Hiroyuki Ishikura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/989,230

(22) Filed: May 25, 2018

(65) Prior Publication Data

US 2018/0275593 A1 Sep. 27, 2018

Related U.S. Application Data

(63) Continuation of application No. 15/642,380, filed on Jul. 6, 2017, which is a continuation of application No. 15/384,349, filed on Dec. 20, 2016, now Pat. No. 9,740,160, which is a continuation of application No. 15/098,356, filed on Apr. 14, 2016, now Pat. No. 9,575,445, which is a continuation of application No.

(Continued)

(30) Foreign Application Priority Data

Feb. 27, 2014 (JP) ..... 2014-036239

(51) Int. Cl.
*G03G 15/00* (2006.01)
*G03G 15/20* (2006.01)

(52) U.S. Cl.
CPC ..... *G03G 15/80* (2013.01); *G03G 15/205* (2013.01)

(58) Field of Classification Search
CPC .. G03G 15/205; G03G 15/2039; G03G 15/20; G03G 15/70; H04N 1/00891; H04N 1/00928; Y02B 60/1267
USPC ..... 366/70; 399/70
See application file for complete search history.

(56) References Cited

U.S. PATENT DOCUMENTS 5,809,369 A * 9/1998 Furuya ..... G03G 15/2003 399/70
6,895,309 B2 * 5/2005 Ito ..... G04G 15/006 367/141

(Continued)

OTHER PUBLICATIONS

Ishikura, "Image Formation Device and Method for Starting Image Formation Device", U.S. Appl. No. 15/642,380, filed Jul. 6, 2017.

*Primary Examiner* — Christopher E Mahoney
(74) *Attorney, Agent, or Firm* — Keating & Bennett, LLP

(57) ABSTRACT

An image formation device includes a power controller that controls transition to an energy-saving mode to reduce power consumption in a standby state and starts up out of the energy-saving mode and a timer in which a timing schedule that starts up the device out of the energy-saving mode is set. The power controller controls the surface temperature of the fixing roller of the image generator to be a temperature lower than the fixing temperature that enables image formation when the image formation device is started up out of the energy-saving mode according to the timing schedule set in the timer.

14 Claims, 5 Drawing Sheets

| | Monday | Tuesday | Wednesday | Thursday | Friday | Saturday | Sunday |
|---|---|---|---|---|---|---|---|
| 9~12 | ON | ON | ON | ON | ON | OFF | OFF |
| 12~13 | OFF | OFF | OFF | OFF | OFF | OFF | OFF |
| 13~17 | ON | ON | ON | ON | ON | OFF | OFF |
| 17~ | OFF | OFF | OFF | OFF | OFF | OFF | OFF |

Related U.S. Application Data

14/615,683, filed on Feb. 6, 2015, now Pat. No. 9,342,001.

(56) References Cited

U.S. PATENT DOCUMENTS

| | | | | |
|---|---|---|---|---|
| 8,831,460 | B2 * | 9/2014 | Hamada | H04N 1/00891 399/90 |
| 9,342,001 | B2 * | 5/2016 | Ishikura | G03G 15/80 |
| 9,575,445 | B2 * | 2/2017 | Ishikura | G03G 15/80 |
| 9,740,160 | B2 * | 8/2017 | Ishikura | G03G 15/80 |
| 2006/0222395 | A1 * | 10/2006 | Yoda | G03G 15/205 399/69 |
| 2008/0056751 | A1 * | 3/2008 | Murata | G03G 15/5004 399/70 |
| 2013/0202320 | A1 * | 8/2013 | Hase | G03G 15/2039 399/44 |
| 2014/0133879 | A1 * | 5/2014 | Seshita | G03G 15/205 399/70 |
| 2014/0314436 | A1 * | 10/2014 | Shibahara | G03G 15/205 399/68 |
| 2015/0037055 | A1 * | 2/2015 | Kitagawa | G03G 15/2046 399/68 |
| 2015/0212464 | A1 * | 7/2015 | Mizuno | G03G 15/2039 399/69 |

* cited by examiner

Day of the week

Time

| | Monday | Tuesday | Wednesday | Thursday | Friday | Saturday | Sunday |
|---|---|---|---|---|---|---|---|
| 9~12 | ON | ON | ON | ON | ON | OFF | OFF |
| 12~13 | OFF | OFF | OFF | OFF | OFF | OFF | OFF |
| 13~17 | ON | ON | ON | ON | ON | OFF | OFF |
| 17~ | OFF | OFF | OFF | OFF | OFF | OFF | OFF |

FIG. 5

Startup time
2/7/2014
(Friday)
9:00

| Job name | Execution time |
|---|---|
| Job A | 2/6/2014 (Thursday), 9:10 |
| Job B | 2/6/2014 (Thursday), 9:20 |
| Job C | 2/6/2014 (Thursday), 9:30 |
| Job D | 2/6/2014 (Thursday), 9:40 |
| Job E | 2/6/2014 (Thursday), 9:50 |
| Job F | 2/6/2014 (Thursday), 10:05 |
| ⋮ | ⋮ |

IMAGE FORMATION DEVICE AND METHOD FOR STARTING IMAGE FORMATION DEVICE

BACKGROUND OF THE INVENTION

1. Field of the Invention

The present invention relates to an image formation device and to a method for starting an image formation device and, more specifically, to an image formation device configured to start automatically out of an energy-saving mode when a timer reaches a set time, and to a method for starting the image formation device.

2. Description of the Related Art

Image formation devices such as multi-functional peripherals (MFPs) that are integrally equipped with a copier, printer, scanner, facsimile and other functions are widespread. Such image formation devices may be equipped with energy-saving modes for reducing power consumed while waiting to operate. In these energy-saving modes, power consumption is reduced while standing by to operate by methods that include turning off the power supplied to unnecessary devices and the like while in standby, halting clocks used for operation, and putting devices that have energy-saving functionality into that state.

Japanese Patent Application Laid-Open Publication No. 2007-274487, for example, describes technology that causes devices to automatically transition to an energy-saving mode and automatically return from the energy-saving mode according to a preset timing schedule. Specifically, this image formation device is equipped with a conduction switching means which switches between whether or not one or a plurality of function blocks that are components or collections of components for image processing are conducting independently of conduction to a communication means, a timing schedule storage means which stores preset timing schedules for conduction control of the function blocks, and a schedule startup control means which, when the function blocks are in a non-conducting state, switches the function blocks to a conducting state by controlling the conduction switching means according to a timing schedule stored in the timing schedule storage means.

In the energy-saving mode described above, power is not supplied to the image generator, either, so the surface of the fixing roller of the image generator is naturally not being warmed. Consequently, when starting up out of the energy-saving mode, it is necessary to raise the surface temperature of the fixing roller of the image generator to the specified temperature and to place the device in a fixing-capable state to be able to form images. At this time, in cases where the device is started up out of the energy-saving mode explicitly by the user pressing an energy-saving cancel button or the like, the possibility of the user being in front of the image formation device and promptly performing image formation processing is considered to be high. It is therefore desirable to rapidly enter a fixing-capable state.

However, it is considered highly unlikely for the user to be in front of the image formation device when it is started up out of an energy-saving mode automatically according to a timing schedule as recited in Japanese Patent Application Laid-Open Publication No. 2007-274487, as opposed to when it is started up out of an energy-saving mode by the user performing an operation. That is, even if the fixing roller is heated and caused to enter into a fixing-capable state while the user is not in front of the image formation device, this only wastefully consumes power by maintaining a heated state and is therefore not desirable.

SUMMARY OF THE INVENTION

In light of the circumstances described above, preferred embodiments of the present invention provide an image formation device and a method for starting an image function device with which wasteful power consumption is significantly reduced or prevented when the device is automatically started out of an energy-saving mode according to a preset timing schedule.

According to a preferred embodiment of the present invention, an image formation device includes a power controller configured or programmed to control transition to an energy-saving mode to reduce power consumption in a standby state and startup out of the energy-saving mode; a display which is not activated in the energy-saving mode; and a timer in which a timing schedule that starts up the image formation device out of the energy-saving mode is set. The power controller is configured or programmed to control the image formation device to be in a first state when forming an image; and the power controller is configured or programmed to control the image formation device to be in a second state in which the display is activated, having an energy consumption lower than an energy consumption of the first state, when the image formation device is started up out of the energy-saving mode according to the timing schedule set in the timer.

According to another preferred embodiment of the present invention, a method for starting an image formation device includes: controlling transition of the image formation device to an energy-saving mode to reduce power consumption in a standby state the image formation device including a display which is not activated in the energy-saving mode; setting a timer in which a timing schedule that starts up the image formation device out of the energy-saving mode is set; controlling the image formation device to be in a first state when forming an image; and controlling the image formation device to be in a second state in which the display is activated, having an energy consumption lower than an energy consumption of the first state, when the image formation device is started up out of the energy-saving mode according to the timing schedule set in the timer.

With various preferred embodiments of the present invention, the surface temperature of the fixing roller is controlled to be a temperature lower than the fixing temperature in a fixing-capable state that is able to form images when automatically starting up out of an energy-saving mode according to a preset timing schedule, so wasteful power consumption is reliably reduced or prevented.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 5 is a diagram showing one example of the job history stored in an HDD.

DETAILED DESCRIPTION OF THE PREFERRED EMBODIMENTS

Preferred embodiments of an image formation device and a method for driving an image formation device of the present invention will be described below with reference to the attached drawings.

First Preferred Embodiment

Figure 1:
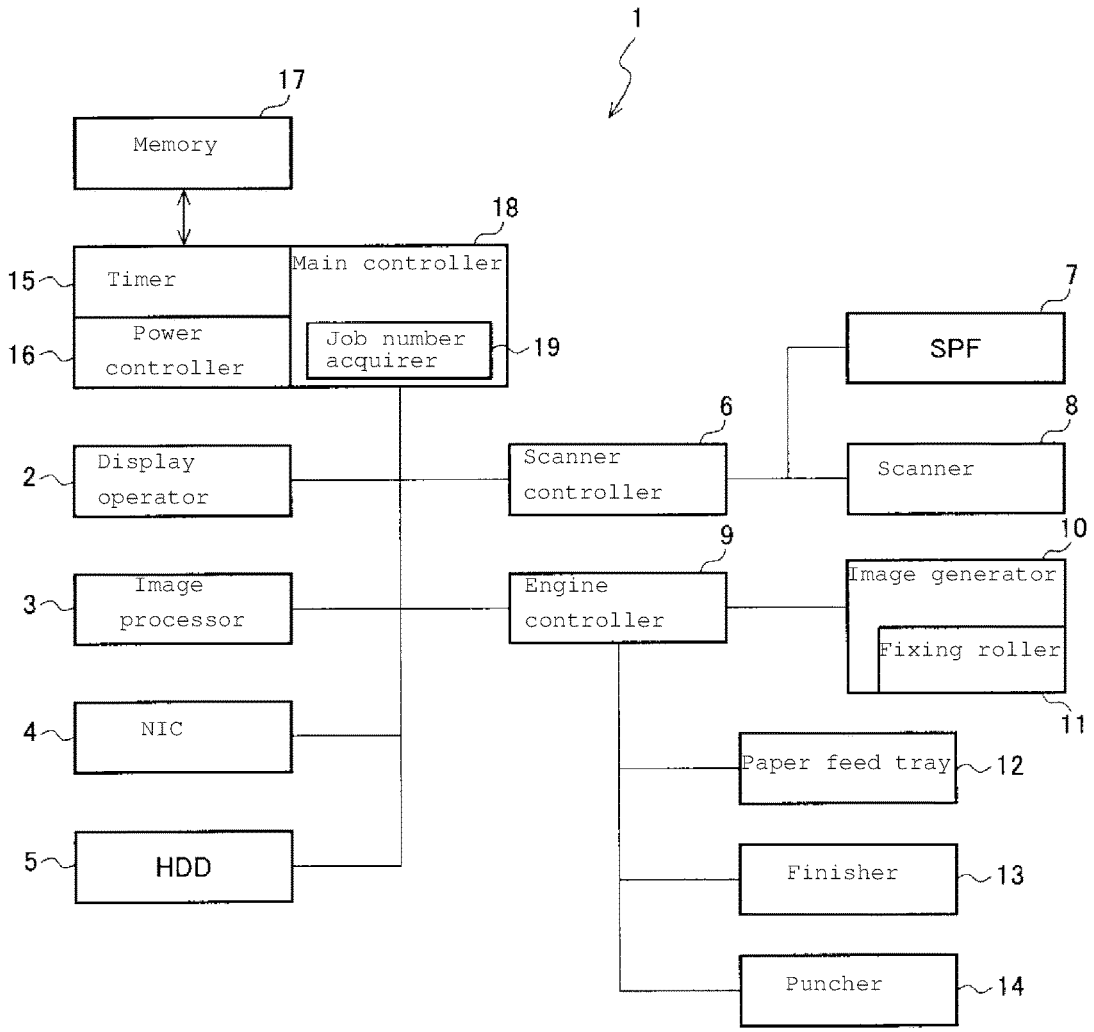
FIG. 1 is a block diagram showing an example of an image formation device according to a preferred embodiment of the present invention.

FIG. 1 is a block diagram showing an example of an image formation device according to a preferred embodiment of the present invention. In FIG. 1, the image formation device 1 preferably includes a display operator 2, an image processor 3, a network interface card (NIC) 4, a hard disk drive (HDD) 5, a scanner controller 6, a single pass feeder (SPF) 7, a scanner 8, an engine controller 9, an image generator 10, a fixing roller 11, a paper feed tray 12, a finisher 13, a puncher 14, a timer 15, a power controller 16, a storage device or memory 17, a main controller 18, and a job number acquirer 19. A multi-functional peripheral (MFP) integrally equipped with a copier, printer, scanner, facsimile, and other functions is a possible example of the image formation device 1. Furthermore, the image formation device 1 preferably is configured to include an energy-saving mode that reduces power consumption in a standby state.

Figures 2, 3:
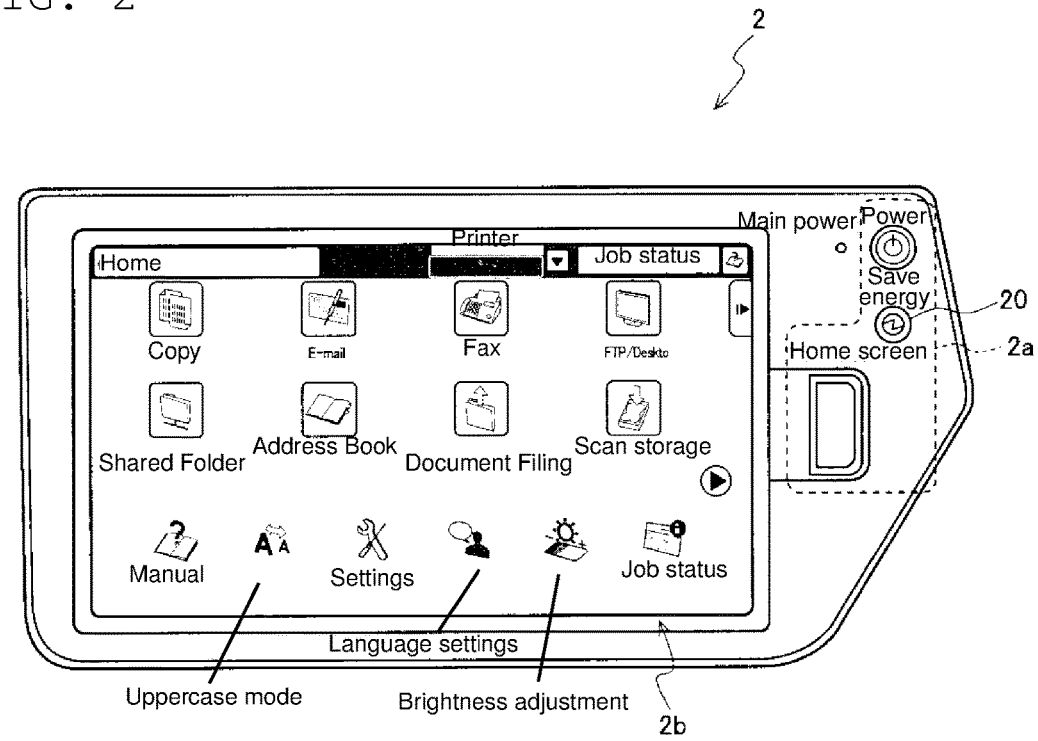
FIG. 2 is a diagram showing one example of the display operator 2 provided in the image formation device 1 shown in FIG. 1.
FIG. 3 is a diagram showing one example of the timing schedules that are set in the timer.

FIG. 2 is a diagram showing one example of the display operator 2 provided in the image formation device 1 shown in FIG. 1. The display operator 2 preferably includes a key operator 2*a* including a group of operating keys configured to accept operation input of various types and a touch panel 2*b* installed with a unitized display panel such as a liquid crystal display (LCD), for example. An energy-saving button 20 configured to put the image formation device 1 into an energy-saving mode and to start it up out of the energy-saving mode via a user operation is installed in the key operator 2*a*. The energy-saving button 20 includes a light-emitting diode (LED) configured to flash when in the energy-saving mode and to alert the user that the image formation device 1 is in an energy-saving state. If this energy-saving button 20 is pressed by the user when the image formation device 1 is in an energy-saving state, the image formation device 1 can be started up out of the energy-saving mode.

The NIC 4 is a communication interface configured to connect, over a local area network (LAN) or a network such as the Internet, to an external information processing device (a personal computer or the like) such that communications are enabled. The HDD 5 is one non-limiting example of the storage device or memory according to various preferred embodiments of the present invention, and it stores image data sent from an external information processing device, job histories that associate jobs with their execution times, and the like.

The scanner controller 6 is a local controller configured or programmed control the operation of the SPF 7 and the scanner 8, and it is connected such that mutual communications are enabled with the power controller 16, the main controller 18, and the engine controller 9 as well. The SPF 7 includes a document tray in which a plurality of sheets of documents can be set and performs processing to transport documents in the document tray to a specified reading position in the scanner 8. The scanner 8 includes imaging elements such as charge coupled devices (CCD) and performs processing to optically read documents transported from the SPF 7 in a state in which an optical device that includes these imaging elements is fixed in a specified reading position. Moreover, the scanner 8 preferably is also configured to perform processing to read the document placed on the platen glass (not shown) while the optical device is being moved.

The image processor 3 preferably includes a dedicated signal processing circuit, a digital signal processor (DSP), or the like, and is configured to perform processing that converts document image data read by the scanner 8 into printing data.

The engine controller 9 is a local controller configured or programmed to control the operation of the image generator 10, the paper feed tray 12, the finisher 13, and the puncher 14, and it is connected such that mutual communications are enabled with the power controller 16, the main controller 18, and the scanner controller 6 as well. The image generator 10 is equipped, for example, with a photosensitive drum that bears the image, a charging device that charges the photosensitive drum, an exposure device that writes an electrostatic latent image based on printing data onto the surface of the photosensitive drum, a developing device that develops the electrostatic latent image on the photosensitive drum as a toner image, a transfer device that transfers the developed toner image onto recording paper, and a motor that drives rollers for the photosensitive drum, recording paper transport, and the like. In addition, the image generator 10 includes the fixing roller 11 defining a fixing device that heats and fixes the toner image which is transferred onto the recording paper, and a heater (not shown) is built into the fixing roller 11.

As was described above, the image formation device 1 includes the image generator 10 that includes the fixing roller 11, and is configured to control the surface temperature of the fixing roller 11 when images are formed by the image generator such that it rises to a fixing temperature that is able to form images. This fixing temperature is the temperature in the fixing-capable state, and it varies depending on factors such as the machine type of the image formation device 1, the type of paper, the type of toner, and whether image formation is color or monochrome, but it is preferably set in the range of approximately 150° C. to 200° C., for example.

The paper feed tray 12 is shown as an example of a cassette that holds recording paper of various sizes, and preferably is configured to supply recording paper to the image generator 10 when images are formed according to instructions from the engine controller 9. Furthermore, the finisher 13 staples a plurality of sheets of recording paper together, sorts using a shifter, and so on after image formation. Moreover, the puncher 14 is configured to punch holes in recording paper after image formation.

The main controller 18 preferably is a controller that is configured or programmed to comprehensively control the entire operation of the image formation device 1, and to exchange necessary commands and data between main controller 18 and the display operator 2, the image processor 3, the NIC 4, the HDD 5, as well as the power controller 16, the scanner controller 6, and the engine controller 9. Here, when the image formation device 1 is in the energy-saving mode, power is supplied to the timer 15, the power controller 16, and the memory 17, but power supply stops to modules other than these. Then, when the energy-saving mode is canceled, power supply starts to each module according to instructions from the power controller 16, and this moves the image formation device 1 to an operation-capable state.

Preferred embodiments of the present invention significantly reduce or prevent wasteful power consumption when automatically starting up out of the energy-saving mode according to a preset timing schedule. According to a preferred embodiment of the present invention, the image formation device 1 is equipped with the power controller 16 configured to control transition to an energy-saving mode that reduces power consumption in a standby state and startup out of the energy-saving mode and the timer 15 configured to set a timing schedule that starts up the device out of the energy-saving mode, and the power controller 16 is configured or programmed to control the surface temperature of the fixing roller 11 of the image generator 10 to be a temperature lower than the fixing temperature that enables image formation when the image formation device 1 starts up out of the energy-saving mode according to the timing schedule set in the timer 15. Note that control of the surface temperature of the fixing roller 11 is executed by the engine controller 9 according to instructions from the power controller 16.

The control target temperature for the fixing roller 11 may be stored in the memory 17 in advance. For example, when the fixing temperature described above is 180° C., the control target temperature is preferably set to be a temperature lower than that such as 100° C. There are no particular restrictions on how this control target temperature is determined, but it is possible, for example, to prepare a plurality of values in advance and to allow the user to set it in a selective manner. In addition, the fixing roller 11 may be put into a preheated (not heated) state. In this case, the image formation device 1 starts up out of the energy-saving state without heating the fixing roller 11.

Conventionally, when the image formation device 1 was started up automatically out of the energy-saving mode according to a timing schedule, power was consumed unnecessarily because the fixing roller 11 was heated up to the fixing temperature and maintained regardless of the fact that it was unlikely that the user would be in front of the image formation device 1 and operating it promptly. By contrast, according to the present preferred embodiment, the surface temperature of the fixing roller 11 is controlled to be a temperature lower than the fixing temperature, so the power required to heat the fixing roller 11 and maintaining its temperature is kept down. Here, the power controller 16 controls the surface temperature of the fixing roller 11 such that it rises to the fixing temperature when the image formation device 1 is started up out of the energy-saving mode according to an operation by the user. That is, when started up out of the energy-saving mode by a user operation such as the pressing of the energy-saving button 20, the user is likely to be in front of the image formation device 1 and to operate it promptly, so it is desirable that the fixing roller 11 be heated up to the fixing temperature and maintained there.

Note that in the example of FIG. 1, for ease of explanation, the timer 15 and the power controller 16 are shown so as to be distinguished from the main controller 18, but the timer 15 and the power controller 16 may be implemented as functions of the main controller 18, for example. Furthermore, the memory 17 is shown as an example of a semiconductor memory such as flash memory and stores timing schedules and the like from which the timer 15 makes references.

FIG. 3 is a diagram showing one example of the timing schedules that are set in the timer 15. In FIG. 3, the vertical axis indicates time, while the horizontal axis indicates the day of the week. This timing schedule can be set as appropriate by the user and is stored in advance in the memory 17. The timer 15 includes a clock function that clocks the current time (i.e., the time, day of the week, date, month, and year). When the time of the timing schedule stored in the memory 17 arrives, the power controller 16 is notified of this fact, and the power controller 16 automatically starts up the image formation device 1 out of the energy-saving mode as described above.

The example of FIG. 3 envisions a timing schedule in which the image formation device 1 is installed in the office of a company that has a two-day weekend. For example, the same timing schedule is set from Monday through Friday. Specifically, between 9:00 and 12:00, the power supply is turned on by starting up out of an energy-saving mode because these are working hours, and then the power supply is turned off by entering energy-saving mode between 12:00 and 13:00 for a lunch break. Then, between 13:00 and 17:00, the power supply is turned on again by starting up out of the energy-saving mode because these are working hours, and then the power supply is turned off by entering the energy-saving mode starting at 17:00 because these are not working hours. By doing so, the schedule automatically starts up out of the energy-saving mode at 9:00 and 13:00, Monday through Friday.

Moreover, because Saturday and Sunday are basically days off, the power is turned off, placing the device in the energy-saving mode for the entire day. Here, even when the image formation device 1 is in the energy-saving mode, it is forcibly started up out of the energy-saving mode if it accepts an operation by the user to turn power on, such as the user pressing the energy-saving button 20 (FIG. 2). When started up by a user operation, the fixing roller 11 is heated until the surface temperature thereof reaches the fixing temperature. In addition, the image formation device 1 forcibly transitions to the energy-saving mode when it accepts an operation by the user to turn power off, such as the user pressing the energy-saving button 20 while the device is running. Furthermore, the image formation device 1 may also be devised so as to automatically transition to the energy-saving mode when the standby state lasts for a certain period of time after it starts up. In either case, if the image formation device 1 is in the energy-saving mode at 9:00 and 13:00 Monday through Friday as described above, it is automatically started up out of the energy-saving mode, and the surface temperature of the fixing roller 11 is controlled to be at a temperature lower than the fixing temperature.

Here, setting of the timing schedule is not limited to the example of FIG. 3. As a modified example, it is also possible to use the time at which the image formation device 1 transitions to the energy-saving mode as the start point and to set the image formation device 1 so as to be automatically started from energy-saving mode when a specified period of time elapses thereafter, for example.

Note that when the image formation device 1 is started up in a state in which the surface temperature of the fixing roller 11 is controlled to be a temperature lower than the fixing temperature, the device has not reached the fixing temperature as it is, so it cannot begin an image forming operation. Therefore, when a specified operational input by the user is detected, such as the user placing a document in the SPF or a print job being received from the user's PC, it is desirable that the surface temperature of the fixing roller 11 be raised to the fixing temperature to put the device in a fixing-capable state that allows image formation, thus making transition to image forming operation possible.

Figure 4:
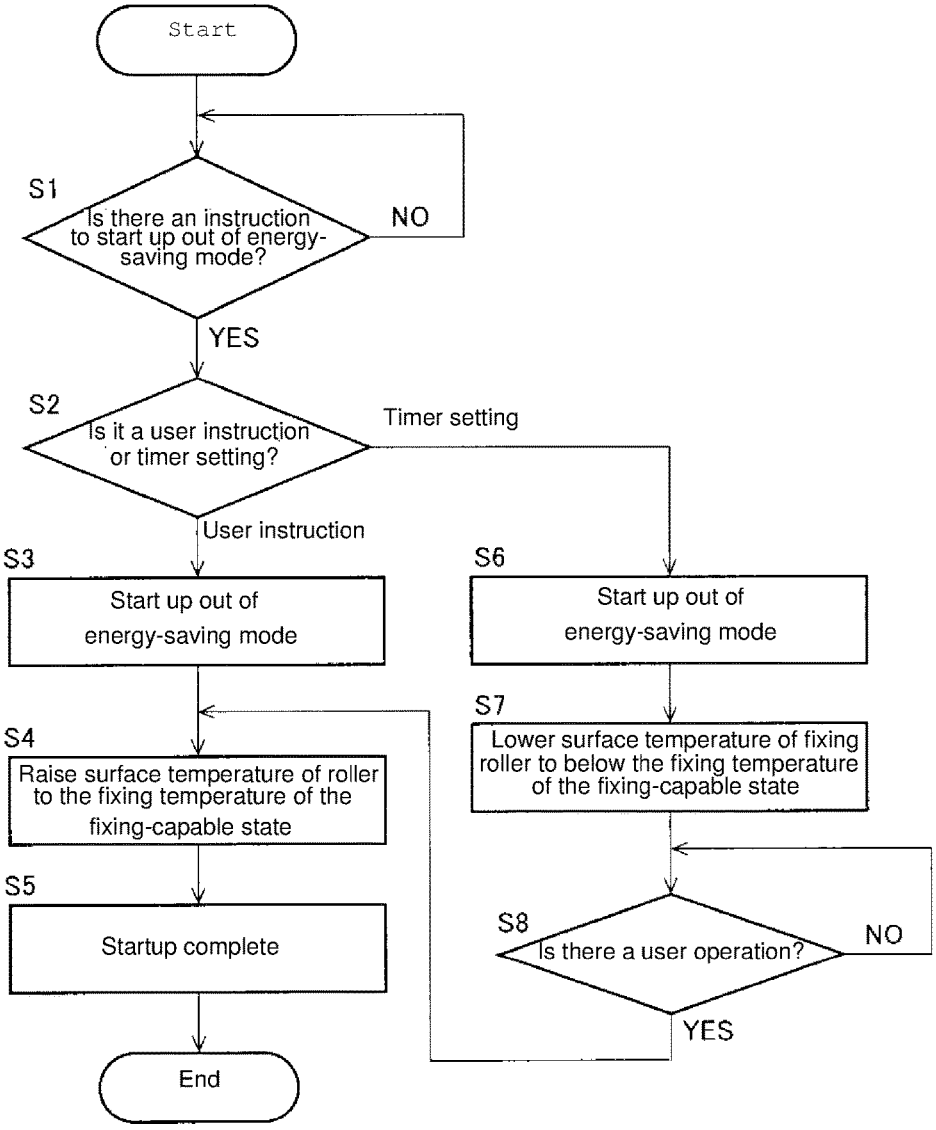
FIG. 4 is a flowchart for illustrating the method for starting up the image formation device according to be a first preferred embodiment of the present invention.

FIG. 4 is a flowchart for illustrating a non-limiting example of a method for starting up the image formation device 1 according to the first preferred embodiment of the present invention. This example is described in terms of the device configuration of FIG. 1. First, the image formation device 1 that is in the energy-saving mode determines whether or not there has been an instruction to start up out of the energy-saving mode from the power controller 16 (step S1). Here, if it determines that there was an instruction to start up out of the energy-saving mode (in the case of YES), it then determines whether this startup instruction was a user instruction or a timer setting (step S2). Moreover, if it determines in step S1 that there was no instruction to start up out of the energy-saving mode (in the case of NO), it enters a standby state in step S1.

Next, if it is determined in step S2 that the startup instruction of the power controller 16 was a user instruction (in the case of "user instruction" in the figure) such as the pressing of the energy-saving button 20 (FIG. 2), the power controller 16 starts power supply to each module and starts up the device out of the energy-saving mode (step S3). Then, the power controller 16 controls the surface temperature of the fixing roller 11 such that it rises to the fixing temperature of the fixing-capable state (step S4) and completes the startup of the image formation device 1 (step S5).

In addition, if it is determined in step S2 that the startup instruction of the power controller 16 was a timer setting that automatically starts up the device according to a timing schedule set in the timer 15 (in the case of "timer setting" in the figure), then the power controller 16 starts power supply to each module and starts up the device out of the energy-saving mode (step S6, which corresponds to the timer startup step). Then, the power controller 16 controls the surface temperature of the fixing roller 11 to be a temperature lower than the fixing temperature of the fixing-capable state (step S7, which corresponds the temperature control step). Note that in step S7, the fixing roller 11 may remain in a pre-heating state without being heated.

Next, the power controller 16 determines whether or not there was a user operation such as the user placing a document in the SPF 7 (step S8); if it determines that there was a user operation (in the case of YES), it transitions to step S4 and raises the surface temperature of the fixing roller 11 to the fixing temperature such that the device transitions to the fixing-capable state. Furthermore, if it determines in step S8 that there was no user operation (in the case of NO), it transitions to a standby state in step S8.

Second Preferred Embodiment

In the first preferred embodiment described above, the control target temperature of the fixing roller 11 preferably was set to be a temperature lower than the fixing temperature when the device was automatically started up out of the energy-saving mode according to the timing schedule set in the timer 15. In the present preferred embodiment, however, the number of past jobs executed around the startup time according to the timing schedule is acquired, and the control target temperature of the fixing roller 11 is set based on whether the number of jobs is large or small.

The image formation device 1 in FIG. 1 preferably includes the HDD 5, which is one non-limiting example of the storage device or memory configured to store execution times for each job when the job is executed, and the job number acquirer 19 which acquires from the HDD 5 the number of jobs executed within a time segment that includes the time at which the image formation device 1 is started up out of the energy-saving mode according to the timing schedule set in the timer 15. The power controller 16 controls the surface temperature of the fixing roller 11 to be a first temperature that is lower than the fixing temperature if the number of jobs acquired by the job number acquirer 19 is smaller than a specified value, and it controls the surface temperature of the fixing roller 11 to be a second temperature that is higher than the first temperature but lower than the fixing temperature if the number of jobs acquired by the job number acquirer 19 is equal to or greater than the specified value. Here, the specified value described above (threshold value) is displayed on the settings screen by the display operator 2 such that it can be specified by the user as appropriate.

FIG. 5 is a diagram showing one non-limiting example of the job history stored in the HDD 5. Execution times (time, day of the week, date, month, and year) are stored on the HDD 5 for each job (job A, job B, . . . ) as shown here. For example, when the startup time according to the timing schedule set in the timer 15 is "9:00, Feb. 7, 2014 (Friday)," the number of jobs executed in the time segment 9:00 to 10:00 on the previous day (Feb. 6, 2014 (Thursday)) is counted. In the example of FIG. 5, jobs A through E were executed in this time segment (9:00 to 10:00), and the number of jobs counted is "5." Note that if the startup time was 10:10, for example, the number of jobs would be counted for the time segment of 10:00 to 11:00 of the previous day. If the startup time is XX:YY, the time segment that is referenced is X:00 to (X+1):00.

If the user assigns the specified value to be "10," the number of jobs is smaller than the specified value, so the surface temperature of the fixing roller 11 is controlled to be a first temperature that is lower than the fixing temperature. Moreover, were the number of jobs to be "15," the number of jobs would be greater than the specified value, so the surface temperature of the fixing roller 11 would be controlled to be a second temperature that is higher than the first temperature and lower than the fixing temperature. For example, if the fixing temperature is 180° C., the first temperature could be set to 100° C. and the second temperature to 150° C. Note that when the surface temperature of the fixing roller 11 is raised to the fixing temperature, it naturally reaches the fixing temperature faster when raised from the second temperature. For this reason, in time segments that have higher numbers of jobs, keeping the surface temperature of the fixing roller 11 relatively high allows the fixing-capable state to be reached promptly, so it is desirable. In addition, differing values can be specified for color printing and monochrome printing as the specified values described above.

Thus, if there are fewer jobs executed in a time segment that includes the startup time of the image formation device 1, the surface temperature of the fixing roller 11 is maintained at a relatively low temperature, so the amount of power consumed in heating and maintaining the temperature of the fixing roller 11 is maintained at a low level. On the other hand, if there are many jobs executed in this time segment, the surface temperature of the fixing roller 11 is maintained at a relatively high temperature, so the fixing roller 11 can move into the fixing-capable state quickly when forming images while keeping the amount of power consumed in heating and maintaining the temperature of the fixing roller 11 down.

Note that in the example of FIG. 5, the job history of the previous day was shown as an example, but the job history is not limited to this. For instance, the job history for each day of the week in the past may be used. Specifically, if the image formation device 1 is started up on Friday of a given week, the job history for Friday of the previous week is referenced. Furthermore, time segments of one hour each such as 9 to 10, 10 to 11, and 11 to 12 were used as the time segment that includes the startup time in the above example, but with the startup time being taken as a reference, time segments that are ±10 minutes or ±1 hour from it, for example, may also be set, and there are no particular restrictions on how the time segment that includes the startup time is determined.

Figure 6:
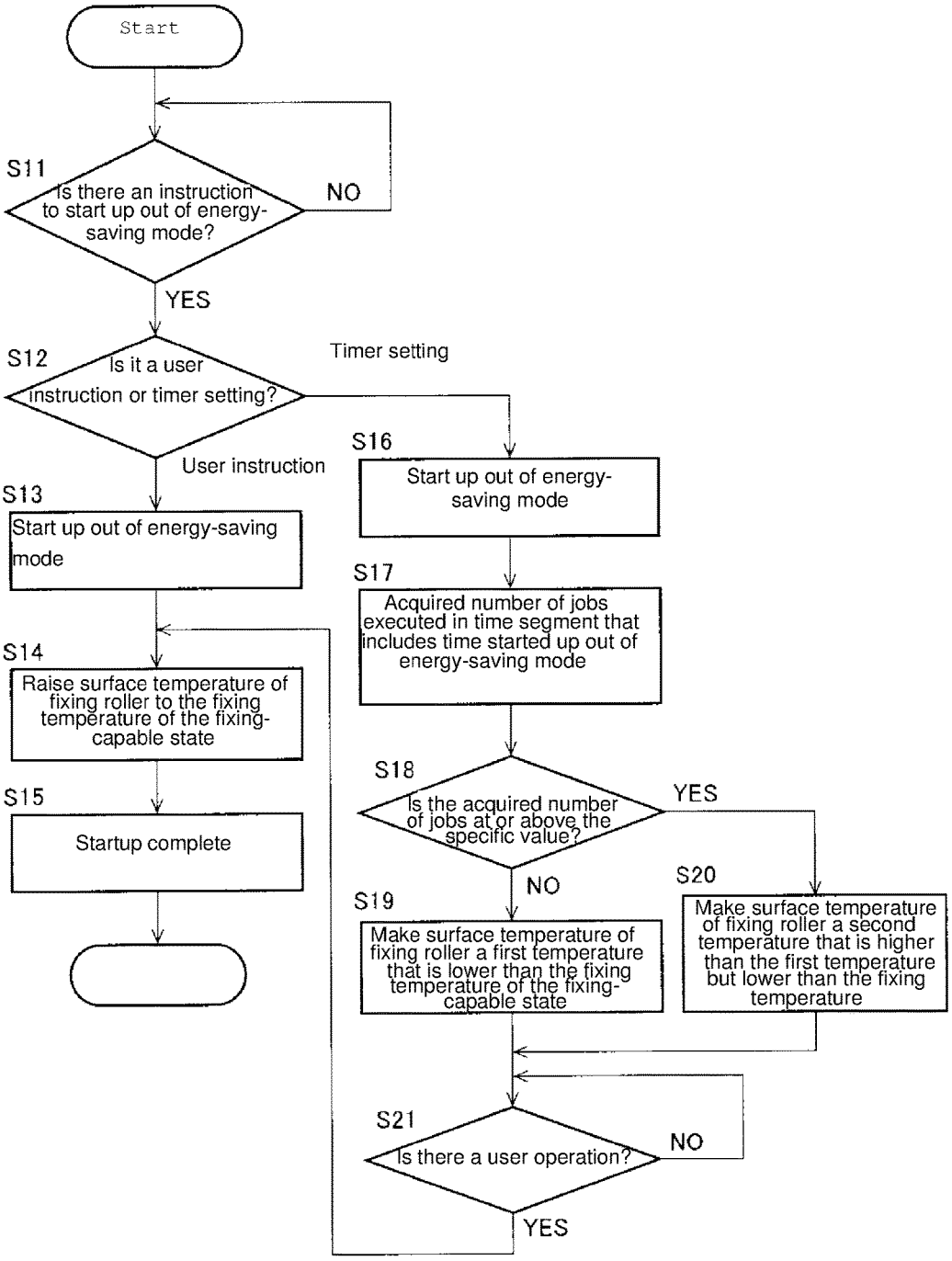
FIG. 6 is a flowchart for illustrating the method for starting up the image formation device according to be a second preferred embodiment of the present invention.

FIG. 6 is a flowchart for illustrating a non-limiting example of a method for starting up the image formation device 1 according to the second embodiment of the present invention. As with the first preferred embodiment, this example is also described in terms of the device constitution of FIG. 1. First, the image formation device 1 that is in the energy-saving mode determines whether or not there has been an instruction to start up out of the energy-saving mode from the power controller 16 (step S11). Here, if it determines that there was an instruction to start up out of the energy-saving mode (in the case of YES), then it determines whether this startup instruction was a user instruction or a timer setting (step S12). Moreover, if it determines in step S11 that there was no instruction to start up out of the energy-saving mode (in the case of NO), then it transitions to a standby state in step S11.

Next, if it is determined in step S12 that the startup instruction of the power controller 16 was a user instruction (in the case of "user instruction" in the figure) such as the pressing of the energy-saving button 20 (FIG. 2), then the power controller 16 starts power supply to each module and starts up the device out of the energy-saving mode (step S13). Then, the power controller 16 controls the surface temperature of the fixing roller 11 such that it rises to the fixing temperature of the fixing-capable state (step S14) and completes the startup of the image formation device 1 (step S15).

In addition, if it is determined in step S12 that the startup instruction of the power controller 16 was a timer setting that automatically starts up the device according to a timing schedule set in the timer 15 (in the case of "timer setting" in the figure), the power controller 16 starts power supply to each module and starts up the device out of the energy-saving mode (step S16, which corresponds to the timer startup step).

Next, the job number acquirer 19 acquires the number of jobs executed in the time segment that includes the startup time at which the image formation device 1 was started up out of the energy-saving mode (step S17), and the power controller 16 determines whether or not the number of jobs acquired by the job number acquirer 19 is equal to or greater than the specified value (step S18). Here, if it determines that the number of jobs is not equal to or greater than the specified value (smaller than the specified value) (in the case of NO), it controls the surface temperature of the fixing roller 11 to be a first temperature lower than the fixing temperature of the fixing-capable state (step S19). Furthermore, if it determines in step S18 that the number of jobs is equal to or greater than the specified value (in the case of YES), then it controls the surface temperature of the fixing roller 11 to be a second temperature that is higher than the first temperature but lower than the fixing temperature (step S20). These steps S19 and S20 correspond to the temperature control step.

Next, the power controller 16 determines whether or not there was a user operation such as the user placing a document in the SPF 7 (step S21), and if it determines that there was a user operation (in the case of YES), it transitions to step S14 and raises the surface temperature of the fixing roller 11 to the fixing temperature. Moreover, if it determines in step S21 that there was no user operation (in the case of NO), then it transitions to a standby state in step S21.

Third Preferred Embodiment

In the second preferred embodiment described above, a single specified value was assigned for the number of executed jobs in the job history executed in the time segment that includes the startup time, and the control target temperature of the fixing roller 11 was thus set to either a first temperature or a second temperature. In the present preferred embodiment, on the other hand, a plurality of specified numbers can be assigned for the number of executed jobs, and the control target temperature of the fixing roller 11 is thus set in a stepwise manner.

If the user assigns "5" and "10" as the plurality of specified values, for example, the number of jobs executed is compared to the plurality of specified values, and it is determined whether the number of executed jobs is in one of the ranges 0 to 5, 6 to 10, or 11 and above. Specifically, if the number of executed jobs is "7," for instance, the range is determined to be 6 to 10. In addition, a first temperature, a second temperature, and a third temperature are respectively assigned a correspondence to one of these ranges as the control target temperature of the fixing roller 11. Note that preferably there is a relationship such that First temperature<Second temperature<Third temperature<Fixing temperature.

In the description above, the second temperature preferably is the control target temperature in the range 6 to 10. Here, the control target temperature was made settable in three levels, but the control target temperature can be set in four levels or more by setting more finely gradated specified values. By setting the control target temperature into more finely gradated levels in this manner, the transition to the fixing-capable state is performed quickly while keeping the power consumption down more effectively.

The image formation device 1 preferably includes the HDD 5 that stores an execution time for each job when the job is executed and the job number acquirer 19 that acquires from the HDD 5 the number of jobs executed within the time segment that includes the time at which the image formation device 1 is started up out of the energy-saving mode according to the timing schedule set in the timer 15, and the power controller 16 compares the number of jobs acquired by the job number acquirer 19 with a plurality of specified values and controls the surface temperature of the fixing roller 11 in a stepwise manner to be a temperature that is lower than the fixing temperature in accordance with the results of comparison.

Fourth Preferred Embodiment

As a yet another preferred embodiment of the present invention, it is also possible to determine whether there are more color jobs or more monochrome jobs among executed jobs in the history of jobs executed in the time segment that includes the startup time and to set the second temperature as the control target temperature when color jobs are more frequent, but to set the first temperature as the control target temperature when monochrome jobs are more frequent. Note that preferably there is a relationship such that First temperature<Second temperature<Fixing temperature.

When comparing machines of the same type, color printing generally tends to use a higher fixing temperature than monochrome printing. Because of this, when color jobs are more frequent in the time segment that includes the startup time, the second temperature is set as the control target temperature, while when monochrome jobs are more frequent, the first temperature is set as the control target temperature. Whether an individual job is a color job or monochrome job may be stored in the HDD 5 as the job history of FIG. 5. Then, the job number acquirer 19 acquires the number of color jobs and the number of monochrome jobs from the HDD 5 for the time segment that includes the startup time. By doing so, it can determine whether there are more color jobs or more monochrome jobs.

The image formation device 1 preferably includes the HDD 5 that stores execution times and a color/monochrome distinction for each job when the job is executed and the job number acquirer 19 that acquires from the HDD 5 the number of color jobs and the number of monochrome jobs executed within a time segment that includes the time at which the image formation device 1 is started up out of the energy-saving mode according to the timing schedule set in the timer 15, and the power controller 16 controls the surface temperature of the fixing roller 11 to be a first temperature that is lower than the fixing temperature if the number of color jobs acquired by the job number acquirer 19 is smaller than the number of monochrome jobs, while it controls the surface temperature of the fixing roller 11 to be a second temperature that is higher than the first temperature but lower than the fixing temperature if the number of color jobs acquired by the job number acquirer 19 is equal to or greater than the number of monochrome jobs.

Each preferred embodiment of the present invention was described above using an image formation device and a method for starting up this device as non-limiting examples, but the present invention may also take the form of a program for making a computer execute this startup method or the form of a computer-readable recording medium that records this program.

Also, a CD-ROM (-R/-RW), optical disc, hard disk (HD), DVD-ROM (-R/-RW/-RAM), flexible disc (FD), flash memory, memory card, memory stick, or other types of ROM or RAM, and the like may be envisioned as the recording medium described above, and the starting methods of preferred embodiments of the present invention described above are easily realized by recording and distributing programs for making computers execute the methods on these recording media. In addition, the startup method according to preferred embodiments of the present invention can be executed by inserting a recording medium as described above into an information processing device such as a computer and reading a program using the information processing device, or by storing this program on a recording medium with which an information processing device is equipped and then reading the program as necessary.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An image formation device comprising:

a power controller configured or programmed to control transition to an energy-saving mode to reduce power consumption in a standby state and startup out of the energy-saving mode;

a display which is not activated in the energy-saving mode; and a timer in which a timing schedule that starts up the image formation device out of the energy-saving mode is set; wherein the power controller is configured or programmed to control the image formation device to be in a first state when forming an image; and the power controller is configured or programmed to control the image formation device to be in a second state in which the display is activated, having an energy consumption lower than an energy consumption of the first state, when the image formation device is started up out of the energy-saving mode according to the timing schedule set in the timer.

2. The image formation device according to claim 1, wherein the image formation device enters the energy-saving mode according to at least one time of one day of the week.

3. The image formation device according to claim 2, wherein the at least one time of one day of the week when the image formation device enters the energy-saving mode is set in the timing schedule in response to user input.

4. The image formation device according to claim 1, wherein the image formation device starts up out of the energy-saving mode according to at least one time of one day of the week.

5. The image formation device according to claim 4, wherein the at least one time of one day of the week when the image formation device starts up out of the energy-saving mode is set in the timing schedule in response to user input.

6. The image formation device according to claim 1, wherein the power controller is configured or programmed to control the image formation device to transition from the second state to the first state in response to a user operation.

7. The image formation device according to claim 1, further comprising a fixing roller; wherein when the power controller controls the image formation device to be in the second state, the fixing roller is not heated.

8. A method for starting an image formation device, the method comprising:

controlling transition of the image formation device to an energy-saving mode to reduce power consumption in a standby state the image formation device including a display which is not activated in the energy-saving mode;

setting a timer in which a timing schedule that starts up the image formation device out of the energy-saving mode is set;

controlling the image formation device to be in a first state when forming an image; and controlling the image formation device to be in a second state in which the display is activated, having an energy consumption lower than an energy consumption of the first state, when the image formation device is started up out of the energy-saving mode according to the timing schedule set in the timer.

9. The method according to claim 8, further comprising:

controlling the image formation device to enter the energy-saving mode according to at least one time of one day of the week.

10. The method according to claim 9, further comprising:

setting the at least one time of one day of the week when the image formation device enters the energy-saving mode in the timing schedule in response to user input.

11. The method according to claim 8, further comprising:

controlling the image formation device to start up out of the energy-saving mode according to at least one time of one day of the week.

12. The method according to claim 11, further comprising:

setting the at least one time of one day of the week when the image formation device starts up out of the energy-saving mode in the timing schedule in response to user input.

13. The method according to claim 8, further comprising:

controlling the image formation device to transition from the second state to the first state in response to a user operation.

14. The method according to claim 8, wherein the step of controlling the image formation device to be in a second state is performed while a fixing roller included in the image formation device is not heated.

* * * * *